United States Patent [19]

Pfeifer

[11] 4,228,519

[45] Oct. 14, 1980

[54] MONITORING METHOD AND SYSTEM FOR A PARKING LOT

[75] Inventor: Heinrich Pfeifer, Villingen-Schwenningen, Fed. Rep. of Germany

[73] Assignee: Kienzle Apparate GmbH, Villingen, Fed. Rep. of Germany

[21] Appl. No.: 948,407

[22] Filed: Oct. 4, 1978

[30] Foreign Application Priority Data

Oct. 5, 1977 [DE] Fed. Rep. of Germany ..... 2744768

[51] Int. Cl.[3] ..... G07C 1/30

[52] U.S. Cl. ..... 364/900; 58/141; 194/DIG. 22; 235/92 T; 340/51

[58] Field of Search ..... 340/51; 58/141, 142, 58/143; 194/DIG. 21, DIG. 22; 235/92 T, 92 TC; 364/900 MS File, 200 MS File

[56] References Cited

U.S. PATENT DOCUMENTS

| | | | |
|---|---|---|---|
| 3,603,960 | 9/1971 | Sanchez | 340/51 |
| 3,641,314 | 2/1972 | Abramson | 340/51 |
| 3,930,363 | 1/1976 | Rubenstein | 194/DIG. 22 |
| 3,948,375 | 4/1976 | Selby, Jr. | 340/51 |
| 3,952,850 | 4/1976 | Anderson et al. | 340/51 |
| 3,998,307 | 12/1976 | Kolben et al. | 194/DIG. 22 |
| 4,005,571 | 2/1977 | Wolff | 235/92 T |
| 4,031,991 | 6/1977 | Malott | 340/51 |

*Primary Examiner*—Leo H. Boudreau

*Attorney, Agent, or Firm*—Toren, McGeady and Stanger

[57] ABSTRACT

A method for electronically monitoring parking lots and an electronic monitoring system for carrying out such method are disclosed. The method and system employs the use of a central control unit and a plurality of parking meters connected to the central control unit. The central control unit generates the time of day which is sent to and electronically stored in each parking meter. Depending on the number of coins inserted in a meter, an amount of time corresponding to the coins is calculated based on a given tariff. This time is added to the time of day to determine a time of departure. This time is indicated on indicating means provided at each meter. The actual time of day and the paid-for parking time are repeatedly compared until they are equal. At that time, the indicating means is cleared. A microprocessor, a variable storage element and a fixed storage element are provided at each meter to effect the necessary calculations and storage required. Additional features are also disclosed.

15 Claims, 2 Drawing Figures

MONITORING METHOD AND SYSTEM FOR A PARKING LOT

FIELD OF THE INVENTION

The present invention relates to a vehicle monitoring method for parking lots and especially to an electronic monitoring system for carrying out such method in which a central control unit cooperates with a plurality of individual parking meters connected thereto.

BACKGROUND OF THE INVENTION

In monitoring systems for parking lots, it is very essential to be as flexible as possible with respect to the tariff. It should be possible to apply one tariff for week days, for example, and another for Saturdays, for Sundays or other holidays. It should also be possible to permit certain parking times to be free of charge and to leave a vehicle on the parking space over a longer time interval than originally set, nevertheless charging the owner of the vehicle with the correct fee in accordance with the tariff. Apart from that, of course, a plurality of coins should be usable. An additional requirement is that the supervising of the payment of the fees for each individual parking space should be as simple as possible and as inexpensive as possible. The user of the parking space, furthermore, wants to be relieved from having to make complicated calculations with respect to a table supplying the tariff data. After having inserted a coin, the user should also be able to read from the parking meter itself the amount of time for which he has paid his parking fees without having to make any calculations.

All known monitoring systems for parking spaces fulfill these demands to only a limited extent. Generally known mechanical curbside parking meters are not particularly usable for parking spaces since they are not very flexible in their tariff organization, especially when night and weekend tariffs and a longer prepayment interval have to be taken into consideration. Even if an intricate arrangement of scales and indicators, and corresponding control of the clockwork of such mainly mechanical parking meter were provided, the disadvantage remains that the user of the parking meter would be forced to make complicated calculations with respect to the parking time made available to him for the coins to be inserted employing the available tariff data before he arrives at the desired result.

Another known monitoring system for parking lots are the so-called ticket issuing devices. At a central spot within a parking area, for instance, on each deck of a parking house, such a ticket issuing device is installed. The vehicle owner has to walk to this device to insert his coins and to obtain the so-called ticket which shows the time of departure. By means of this ticket, the user must return to his vehicle and must place it behind the windshield so that it is visible from outside. It is understandable that such a ticket issuing device is only very reluctantly accepted by the users since users who are not subscribers in a certain parking lot do not generally know the parking area very well and therefore have to spend much time looking for the ticket issuing device to obtain this ticket and return therewith to the vehicle. Apart from that, due to its complexity, this system requires a lot of supervisory expense for the operator of the parking lot. Other examples for such ticket issuing devices are described, for example, in DE-Offenlegungsschrift 15 74 180.

In French Pat. No. 13 94 660, a monitoring system for parking spaces is disclosed, having a central control unit and individual parking meters attributed to the individual parking spaces. This system works on the electromechanical principle and payment is effected after use. The customer, after having placed his vehicle in the parking space, either by means of the vehicle itself or by any other manipulation which the driver has to make, sets the time and coin indicating device in motion. Fees do not have to be paid at the beginning but the parking space is automatically closed. During the parking time, by means of a central control unit, each individual parking meter is switched on in accordance with the time of day. Differing tariffs for day times and night times can be taken into consideration, so that varying tariffs in accordance with day or night times are possible. When the customer returns, he can read off the fee to be paid on the parking meter. He inserts the coins since only in this manner can he open the gate closing his parking space, so that he can drive away.

The just described system has two essential disadvantages. The payment-on-return system can only function in connection with gates or other closing means for the individual parking spaces. This, however, is a very expensive installation. Further, the electromechanical embodiment shown in the above-mentioned patent specification is not very flexible with respect to the tariff organization and allows only advance payments to a very limited extent for a longer period of time.

OBJECTS OF THE INVENTION

It is therefore an object of the present invention to devise a monitoring system for parking lots in which every individual parking space is provided with a parking meter having an indicating device attributed to this parking space. A particular object of the invention is that the individual parking meter, however, should be as flexible as possible with respect to the tariff organization so that the customer need not make complex calculations with the aid of tariff tables. The meter should indicate directly what the valid time of departure is, after a proper coin has been inserted. In addition, it is an object that the system should require the most simple supervision to determine whether a vehicle which has been placed on a certain parking space is also authorized to be there and what fines have to be paid or, in other words, how much the paid parking time has been exceeded. In order to be able to realize all these demands, the use of a microcomputer for each individual parking meter has proved to be the only solution which is economically sensible. Correspondingly, the invention has been realized in the form of an operating method employing such microcomputer.

SUMMARY OF THE INVENTION

In accordance with the present invention, a method for electronically monitoring a parking lot using a central control unit and a plurality of individual parking meters connected to the central control unit comprises the steps of supplying each individual parking unit with the actual time of day from the central control unit, determining, for the number of valid tariff coins inserted in a parking meter, an amount of time corresponding to the valid tariff coins, the determined time being added to the actual time of day to arrive at a parking time until which the tariff has been paid, and repeatedly comparing the actual time of day with the paid-for parking time to determine whether the paid-for parking time has been exceeded. In one form of the invention, the method includes indicating the parking time until which the tariff has been paid at the meter and clearing the indicator when the paid-for parking time has been exceeded.

In this way, it is possible that each customer, upon insertion of a tariff coin, immediately recognizes upon the indicating means of his individual parking meter up to which time he has paid his parking fee by this coin. When several coins are inserted subsequently, the parking time is correspondingly extended. Calculation of the time of departure is effected with consideration of all tariff data put in and for a period of time up to a week in advance. As long as this time of departure has not been reached, the indication at the parking meter is retained so that the supervisor can always recognize whether the fee has been paid for the individual parking meter. As soon as the parking time has been exceeded at a particular meter, the indication is cleared so that the supervisor can recognize that the paid parking time has been exceeded. In order that the supervisor may determine how much the paid parking time has been exceeded, the method according to the invention includes the step of storing the last time of departure so that, by way of a switching device to be operated by the supervisor, the last time of departure can be reindicated. By comparing this with the actual time of day, the supervisor can also see how much the parking time has been exceeded.

The method in accordance with the invention also includes a step by which, to the customer as well as to the supervisor, a certain additional delay of grace may be granted or indicated. Upon clearance of the indication by reaching the time of departure to which the fee has been paid, special signs are switched in. These signs, for instance one stroke of a 7-segment-indication, can additionally be controlled to appear simultaneously on all indication positions, which indicating positions can be cleared one position after the other in a certain rhythm. For instance, the providing of the special sign indication is designed such that at the end of the paid parking time, initially, one stroke is shown on four indication positions. At intervals of five minutes, the four strokes are cleared so that after 20 minutes, the whole indication is cleared.

Also, in accordance with the invention, an electronic monitoring system for parking spaces comprises a central control unit having a time unit for providing the actual time of day in digital form and a plurality of individual parking meters. Each meter includes a microprocessor unit, fixed storage means for storing a predetermined program, means for indicating the time of departure of a vehicle and variable storage means for storing digital information representing the actual time of day transmitted from the central control unit and for storing digital information representing the time of departure calculated, in cooperation with said microprocessor, from given tariff data in accordance with coins inserted in the meter. The fixed storage means have a portion of the program for comparing, in cooperation with the microprocessor, the contents of the "time of day" and the "time of departure" portions of the variable storage means, a signal being produced when the stored "time of day" information and the stored "time of departure" information are equal for clearing the indicating means.

For a better understanding of the present invention, reference is made to the following description and accompanying drawings while the scope of the invention will be pointed out in the appended claims.

DESCRIPTION OF THE PREFERRED EMBODIMENTS

Figure 1:
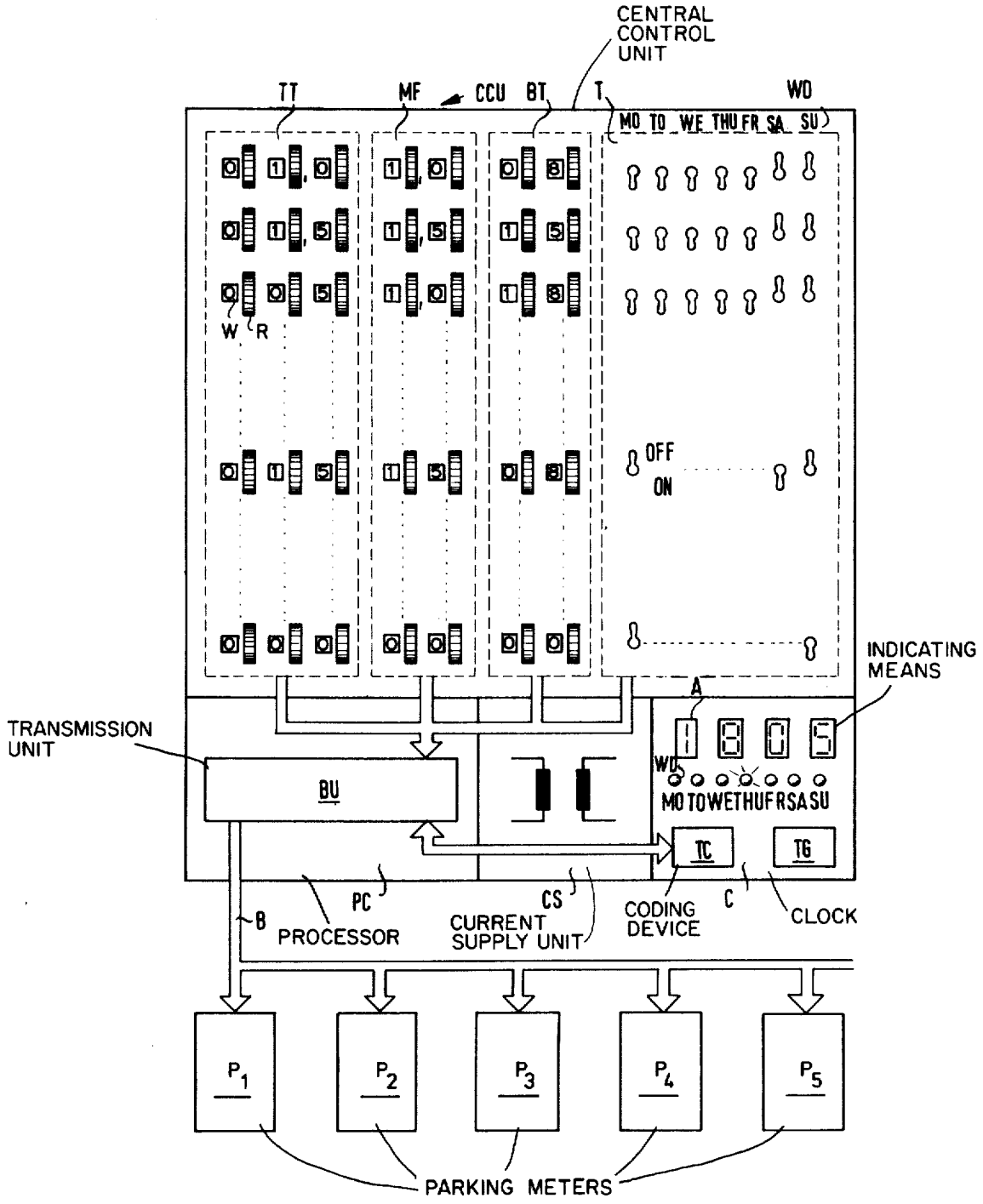
FIG. 1 is an overall circuit diagram of the entire monitoring system for parking spaces.

Referring to FIG. 1, the monitoring system for parking lots includes the central control unit CCU and the individual parking meters P1, P2, P3, P4, P5, etc., which are attributed to the individual parking spaces in a parking house. The control unit CCU and the individual parking meters are connected to each other via a common bus line B. The data transfer on this bus line B is only possible in the direction from the control unit CCU to the parking meter P1, P2, etc. Naturally, it would be possible to realize such a system where data may be transferred in both directions. However, this would naturally mean a higher bus capacity than for the present system where the data transfer is effected only from the central control unit to the individual parking meters.

In the central control unit, a setting table T is provided as well as a clock C, a current supply unit CS and a processor PC. An example of a device which may be employed as processor PC is the TMS 1099 of Texas Instruments which consists of a CPU and a RAM in one chip and a corresponding ROM in a second chip.

First, the details of the setting table T will be explained. It includes one setting unit TT for the tariff, one MF for the minimum parking fee to be paid and one BT for the beginning of each tariff date. The individual indicating elements of the values set up are arranged in columns and rows for each figure to be set. Behind the setting table T, an indicating roller element for the figures "0 to 9" is provided which may be individually visible through a window W. Each individual indicating roller is provided with a knurl wheel R by means of which the indicating roller may be set to the desired figure. In place of the indicating rollers and knurl wheels, other setting and indicating means, such as rotary switches, etc., may be used. On the right side, besides the setting units TT, MF, BT, there is another setting unit WD for the week days.

The manner in which the tariff may be set up is now explained with reference to the example shown in the drawing. From line 1 of the setting units TT, MF, BT and WD, one can recognize that, from Mondays to Fridays, all the five switches Mo to Fr for Monday to Friday in this line have been brought to the "on-position", while the switches Sa and Su for Saturday and Sunday are in the "off-position". At the parking fee according to setting unit TT, 1.00 DM/hour is set and the minimum parking fee in accordance with setting unit MF is also 1.00 DM. This example has been structured in terms of the typical coinage of the native land of the inventor, Germany, where "DM" refers to the deutsch mark. The setting table may readily be structured in terms of any currency, particularly of a currency which is based on a decimal arrangement such as dollars and cents. The starting time for this tariff is 8 o'clock. From the second line it is seen that, for Monday to Friday, starting at 15:00 hours according to setting unit TT, the tariff is 1.50 DM/hour, while the minimum parking fee in this case is also 1.50 DM. After 18:00 hours, it is seen that the tariff is only a 0.50 DM/hour, the minimum parking fee being DM 1.00. In another line of the setting table T, the tariff valid for Saturday may be seen. Here, all switches Monday Mo to Friday Fr and Su are in the off-position and only the switch Sa is in the on-position. This refers to the fact that from 8 o'clock in the morning, in accordance with setting unit BT, the same tariff is valid like Monday to Friday from 15:00 hours, i.e., 1.50 DM/hour and 1.50 DM as minimum parking fee.

Of course, a free-of-charge tariff on the corresponding week days can also be set. From the last line of the setting table T, it is seen that on Sunday—switch Su is in the on-position and all other switches are in the off-position—parking will be free of charge while all switches in the other setting units TT, MF and BT are in the zero position. Instead of setting the time at which a certain tariff begins at the setting unit BT, this unit can also be provided with additional setting positions to provide for a predetermined parking time.

Clock C contains a time pulse generator TG and a time coding device TC by means of which the pulses produced by the time pulse generator are counted and transformed into a digital time indication so that it can be indicated by an electronic 7-segment-indicating means, A, in digital form. Apart from the indication A, the clock C contains indicating lamps WD for Monday until Sunday, with each such lamp being lit on the corresponding actual week day.

The current supplying unit CS contains the usual components for voltage stabilization, voltage transformation, and so on. The processor unit PC contains the transmission unit BU. This unit receives the data from the various setting units TT, MF, BT and WD, so that they can be transmitted upon being called up. The data can be modified at any time by means of the setting units TT, MF, BT and WD. Apart from these data which are delivered by the setting units, the store in PC, continuously receives the actual time of day from a coding device TC in the clock C as well as an indication of the individual week day. The store, in PC, continuously cooperates with the transmission unit BU by the bus B with the individual parking meters P1 to P5. The transmission unit BU works in such manner that at regular intervals the contents of the store, in PC, is interrogated and transmitted to the individual parking meters P; that means the tariff data and the actual time of day are transmitted continuously and repeatedly.

Figure 2:
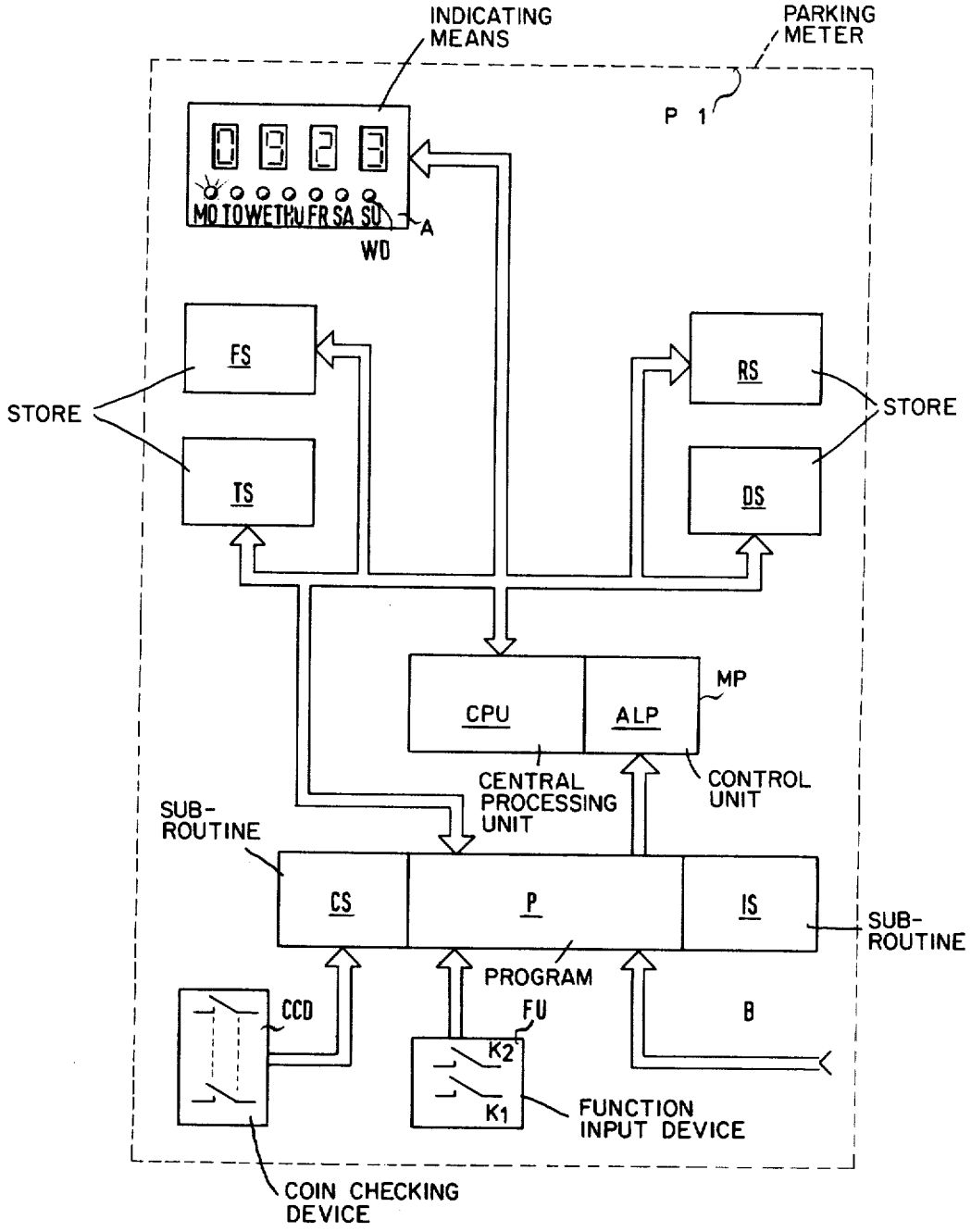
FIG. 2 is a functional block schematic of an individual parking meter.

Each of the individual parking meters P1 to P5 is of the same configuration. A functional scheme of these individual parking meters may be seen in FIG. 2. The individual parking meters are realized by means of a microcomputer; each parking meter contains a microcomputer comprising a microprocessor unit MP which has the usual central processing unit CPU and control unit ALP. Microcomputer devices which may be used in this application are the TMS 1100 and TMS 1000 of Texas Instruments, the Intel 8048 or the Fairchield F 8. Most favorably for this purpose the TMS 1100 is used. However, all microcomputers as mentioned are one-chip computers comprising the processor, the RAM and the ROM. The control unit ALP receives its commands from the program store P. This program store P controls the data transfer between the indicating means A, the various parts of the store FS, TS, RS, DS and the coin checking device CCD, the function input device FU as well as the central control unit CCU via the bus B.

The indicating means in each individual parking meter P is essentially the same as the indicating means A in the clockwork of the central control unit CCU. The indicating means comprises four indicating positions in the form of an electronic 7-segment indicating device. Also, seven indicating lamps WD for the week days are included, indicating the week days Monday to Sunday. On the four indicating positions of the indicating means A, the time is indicated in digital form, simultaneously one of the lamps WO indicates the week day.

The store, including the parts FS,TS,RS and DS, are shown as individual stores since this helps to understand the functional description. It should, however, be pointed out, that, naturally, all these stores may be integrated in a random-access-memory (RAM) as part of the one chip microcomputer. Various places of this memory always represent one of the four individual stores shown. The four storing parts are the fee store FS, the tariff store TS, the result store RS and the day time store DS. The day-time store DS receives the actual time of day from the central control unit CCU. What is being stored here corresponds to the time indicated by C in the central control unit CCU. The result store RS always contains a time, that is, the time of departure up to which the customer has paid his parking fee. The contents of the result store RS is indicated at the indicating means A as long as the parking fee has been paid or as long as the parking space is taken up when there is a sensor for monitoring occupancy of the parking space. The tariff store TS serves to store the data which are set within the individual setting units TS, MF, BT and WD in each individual parking meter P to have them available for calculating the parking time. The fee store FS is only required in each individual parking meter P when coins are inserted to calculate the time of departure from the actual time of day and the parking time in accordance with the prescribed fees. This function is to be described later.

The coin checking unit CCD is a unit by means of which the coins are checked as to whether they are an admissible tariff coin or as to whether it is an inadmissible coin or a counterfeit. The coin checking unit CCD has been shown in FIG. 2 to have a plurality of contacts. To each admissible tariff coin a contact is attributed. The way in which the coins are treated will be explained later in connection with the function of the device. Additionally, there is a function input device FU which, in accordance with FIG. 2, has two contacts K1 and K2. One contact K1 represents the switch which, for instance, may be operated by a key or similar device by the supervisor in order to actuate a supervisory process. The second contact K2 represents a sensor which is actuated when the vehicle enters the parking lot. Such a sensor as represented by the contact K2 can also be made to actuate certain functions within the individual parking meter P.

In the following with respect to a parking process, the function of the system shall be described in detail by taking into consideration the following tariff or coin data. The coin checking device CCD is installed so as to accept three kinds of coins, that is, 0.50 DM, 1.00 DM and 2.00 DM, for example. Each of these coins closes one contact within the coin checking device CCD. The signals produced thereby are encoded by means of the microprocessor MP and result in a corresponding presetting in the fee store FS. For instance, a 0.50 DM coin would result in releasing five pulses into the fee store FS, while a 1.00 DM coin would result in storing 10 pulses in the fee store FS and a 2.00 DM coin 20 pulses. In the tariff store TS, the individual tariff data are stored, for instance tariff I = 0.50 DM/h or 1 pulse = 12 min. parking time tariff II = 1.00 DM/h or 1 pulse = 6 min. parking time tariff III = 1.50 DM/h or 1 pulse = 4 min. parking time By cooperation among the central processing unit CPU, the program store P, the fee store FS, the tariff store TS and the day-time store DS, the fee store FS is eventually cleared and a corresponding number of pulses representing minutes is added to the contents of the day-time store DS which corresponds to the valid tariff as stored in the tariff store TS. The result is stored in the result store RS. For each coin inserted, this calculation is made, with the contents of the result store RS appearing at the indicating means A at the end of each calculating process. As may be seen from FIG. 2 for this individual parking meter, the parking fee has been paid until Monday, 9:23 hours. The actual time of day may be recognized in the central control unit CCU to be Thursday, 18:05 hours. The customer using this parking lot has paid his parking fee for four days in advance.

During the parking time, a subroutine CS contained in the program store P is effective so that the contents of the result store RS is continuously and repeatedly compared with the contents of the actual day-time store DS by means of the central processing unit CPU. As soon as the two registers are in accordance with each other, the indicating means A are cleared.

In the central processing unit CPU, thereafter a subroutine is made operative in the program store P. This causes the showing of a number of special signs on the indicating means. For instance, these special signs can consist in the central bar of the four indicating positions being lit so that at the indicating means A, four strokes appear in side-by-side relationship. These four strokes, which are then indicated, signify that the customer, when he has not yet obtained his vehicle, has only exceeded the paid parking time by a short time. In the course of the following 20 minutes, by means of subroutine IS, one stroke after the other is cleared on the indicating means A so that simultaneously it is made visible by how many minutes the parking time has been exceeded. Assuming that, for instance, for every five minutes one indicating position is completely cleared, then the supervisor can simultaneously recognize when the grace period will have completely run out.

It should be understood that the program P, including subroutines CS and IS, are part of the programmed read-only memory (ROM) as verified in each of the above mentioned one-chip microcomputers.

In order to provide, apart from the immediately indicated overtime, the possibility of supervising any situation where the parking is exceeded, the program store P is programmed so that the result store RS which is available to the indicating means A during the actual parking time retains its contents and is only cancelled when a new coin was inserted or when the contact K2 was opened; that is, only when the old customer has left the parking space or when a new parking customer has appeared. In the time period until the new customer arrives, the contents of the result store RS is retained. If the indicating means A is cleared after the parking time is used up, the supervisor can operate a contact K1 by means of a key within the function input means FU so that the contents of the result store RS is transmitted to the indicating means A. Then, the supervisor can calculate, by comparing the actual time of day with the time of departure, by how much the vehicle has exceeded the parking time. Correspondingly, the customer can be summoned to pay the missing parking fees.

If a sensor is available which reports by way of contact K2 that the vehicle has been removed, this signal clears the result store RS. Thus, when the customer leaves the parking lot before his parking time has been used up, the time previously paid for is lost.

If there is no such sensor, the supervisor can manually clear the remaining parking time by means of the key switch operating the contact K1. With this key switch, two other functions may also be effected:

(a) If a time is still indicated on the indicating means A, the result store RS and thereby also the indicating means A is cleared.

(b) When the parking time has already expired, that is, when there are no figures indicated by the indicating means A, the contents of the result store RS is transmitted to the indicating means A as long as a contact K1 is closed as has been described above.

The process (b) can be repeated until, through the contact K2 or by means of a coin insertion, it is reported that the old customer has left and a new one arrived.

While the foregoing description and drawings represent the preferred embodiments of the present invention, it will be obvious to those skilled in the art that various changes and modifications may be made therein without departing from the true spirit and scope of the present invention.

What is claimed is:

1. A method for electronically monitoring a parking lot using a central control unit and a plurality of individual parking meters connected to the central control unit comprising the steps of:

supplying each individual parking meter with the actual time of day from the central control unit;

determining, for the number and/or value of valid tariff coins inserted in a parking meter, an amount of time corresponding to said valid tariff coins, said determined time being added to said actual time of day to arrive at a time of departure until which the tariff has been paid; and repeatedly comparing the actual time of day with said time of departure in said control unit to determine whether the paid-for parking time has been exceeded.

2. The method of claim 1, also including the steps of indicating the time of departure until which the tariff has been paid at said meter and clearing said indicator when said paid-for parking time has been exceeded.

3. The method of claim 2, also including the step of providing a number of special indications following the clearance of the departure time from the indicator, said special indication not representing a definite time.

4. The method of claim 3, wherein said special indication employs the use of a plurality of signs and also including the step of clearing said signs at a predetermined rhythm.

5. The method of claim 1, wherein data representing the tariff are adjustable at the central control unit and said method includes the step of transmitting said tariff data to be stored in the individual parking meters with a predetermined rhythm.

6. The method of claim 2, including the steps of storing the time of departure of the last user of a parking space after clearing the indication until the beginning of the next parking situation and indicating the last time of departure by an authorized switching process.

7. The method of claim 2, wherein said clearing step is effected by the departure of a vehicle using a parking space before the paid time of departure has been reached.

8. An electronic monitoring system for parking spaces comprising:

a central control unit having a time unit for providing the actual time of day in digital form; and a plurality of individual parking meters, each meter including:

a microprocessor unit;

fixed storage means for storing a predetermined program;

means for indicating the time of departure of a vehicle; and variable storage means for storing digital information representing the actual time of day transmitted from the central control unit and for storing digital information representing the time of departure calculated, in cooperation with said microprocessor, from given tariff data in accordance with coins inserted in said meter;

said fixed storage means having a portion of said program for comparing, in cooperation with said microprocessor, the contents of the "time of day" and "time of departure" portions of said variable storage means, a signal being produced when the stored "time of day" information and the stored "time of departure" information are equal for clearing said indicating means.

9. A monitoring system according to claim 8, wherein each individual parking meter is provided with a key-operated switching device, upon the operation of which a signal is produced which controls the transfer of the time of departure to the indicating means from the storage portion of the variable means containing this information.

10. A monitoring system according to claim 8, wherein said system includes means for providing a special indication in said indicating means after the time indication of said indicating means has otherwise been cleared.

11. A monitoring system according to claims 8 or 10, wherein said special indication contains multiple signs, which special indication is cleared one sign after the other at a definite rhythm, the control of said rhythm being provided by information from said fixed storage means.

12. A monitoring system according to claim 8, wherein each individual parking space for a vehicle to which an individual parking meter is attributed is also provided with a sensor which delivers a signal when the vehicle is moved away to clear the indicating means, said variable storage means storing the time of departure when the vehicle is moved away before the paid parking time is over.

13. The monitoring system of claim 8, wherein said variable storage means is a random-access-memory (RAM) and said fixed storage means is a read-only-memory (ROM).

14. The monitoring system of claim 8, wherein said given tariff data is periodically supplied to each meter by said central control unit.

15. The monitoring system of claim 14, also including means for changing said tariff data.

* * * * *